US006070288A

United States Patent [19]

Luyckx et al.

[11] Patent Number: 6,070,288

[45] Date of Patent: Jun. 6, 2000

[54] STORAGE BAG FOR VACUUM CLEANER ACCESSORIES AND THE LIKE

[75] Inventors: Michael D. Luyckx, Bloomfield Hills, Mich.; Steven R. Umbach, The Woodlands, Tex.; Kenneth Roberts, Rockford, Mich.

[73] Assignee: BISSELL Homecare, Inc., Grand Rapids, Mich.

[21] Appl. No.: 09/078,936

[22] Filed: May 14, 1998

Related U.S. Application Data

[60] Provisional application No. 60/046,545, May 15, 1997.

[51] Int. Cl.[7] ..... A47L 5/00

[52] U.S. Cl. ..... 15/323; 323/410

[58] Field of Search ..... 15/323, 410, 327.1, 15/327.2, 351, 339

[56] References Cited

U.S. PATENT DOCUMENTS

| | | | |
|---|---|---|---|
| 2,340,390 | 2/1944 | Kitto | 15/323 |
| 2,608,709 | 9/1952 | Benjamin | 15/323 |
| 2,716,253 | 8/1955 | Schwarz . | |
| 2,747,214 | 5/1956 | Allen | 15/323 |
| 3,089,177 | 5/1963 | Andersson-Sason . | |
| 4,082,186 | 4/1978 | Chirumbolo . | |
| 4,084,948 | 4/1978 | MacFarland | 15/351 |
| 4,311,493 | 1/1982 | Schaefer et al. | 15/323 |
| 4,541,142 | 9/1985 | Pudwill . | |
| 4,554,700 | 11/1985 | Lyman | 15/327.2 |
| 4,653,638 | 3/1987 | Lackner et al. | 15/323 |
| 4,945,603 | 8/1990 | Herron, Jr. | 15/323 |
| 5,233,722 | 8/1993 | McKnight et al. . | |
| 5,247,719 | 9/1993 | Wareham et al. | 15/323 |
| 5,390,392 | 2/1995 | Thomas et al. | 15/351 |

FOREIGN PATENT DOCUMENTS

| | | |
|---|---|---|
| 672668 | 9/1929 | France . |

*Primary Examiner*—Robert J. Warden, Sr.
*Assistant Examiner*—Andrew Aldag
*Attorney, Agent, or Firm*—Rader, Fishman, Grauer & McGarry An Office of Rader, Fishman & Grauer, PLLC

[57] ABSTRACT

A tool storage module adapted to be mounted to the handle of a vacuum cleaner comprising a handle pivotally mounted to a floor supported base. The accessory storage module has a support panel to which is mounted a pliable storage bag. The storage bag is preferably removably mounted to the support panel. The storage bag is also transparent, made, for example, of a mesh material, for viewing of the contents of the storage bag from outside the storage bag. The storage bag can be sized to receive multiple tools and accessories.

36 Claims, 3 Drawing Sheets

STORAGE BAG FOR VACUUM CLEANER ACCESSORIES AND THE LIKE

CROSS-REFERENCE TO RELATED APPLICATION

This application claims the benefit of provisional patent application Ser. No. 60/046,545 filed May 15, 1997.

BACKGROUND OF THE INVENTION

1. Field of the Invention

This invention relates to a vacuum cleaner with a storage bag for a vacuum cleaner accessories and, more specifically, to a storage bag module which is adapted to be mounted on a handle assembly of an upright vacuum cleaner.

2. Description of Related Art

Upright vacuum cleaners typically comprise a suction-creating base having a pivotably-mounted handle assembly attached thereto. Typically, the handle assembly includes a filter bag therein which is adapted to collect debris from the base. It is known to provide upright vacuum cleaners with a variety of accessory tools for cleaning crevices, drapes, furniture, etc. A hose is typically provided with the vacuum cleaner which has one end adapted to interconnect with the base and a second end adapted to removably mount each of the tools.

The cleaning tools are separate items which are typically mounted to the handle assembly by pockets, clips or other attachment devices which are often integrally formed with the handle assembly, often as part of a casing for the filter bag or as a separate tool rack. Examples of cleaning tool storage devices for vacuum cleaners are shown in U.S. Pat. Nos. 2,716,253, 3,089,177, 4,541,142 and 5,233,722. The collective disclosure of these patents is incorporated herein by reference.

Often, a vacuum cleaner user must replace lost tools or accumulates additional tools not originally provided with the vacuum cleaner. These tools may not fit within the mounting arrangements provided on the vacuum cleaner. In addition, vacuum cleaners often need to have belts and filter bags replaced after use. Most known upright vacuum cleaners do not typically have a means for mounting replacement filter bags and belts for easy access on a vacuum cleaner. The replacement filter bags and belts usually are stored elsewhere and must be retrieved before replacing them on the vacuum cleaner.

SUMMARY OF INVENTION

According to he invention, a versatile tool storage module is adapted to be mounted to a vacuum cleaner of the type that comprises a handle rotatably mounted to a floor-engaging base, and multiple tools for the physical and cleaning operations of the vacuum cleaner. The tool storage module includes a support panel adapted to be mounted to the vacuum cleaner handle in combination with a pliable tool bag mounted to the support panel and at least partially defining a tool storage chamber adapted in size to hold multiple tools for the vacuum cleaner.

The support panel can include a cord wrap adapted to receive wound plies of the vacuum cleaner cord. The cord wrap can comprise a cord wrap knob positioned near an upper end of the support panel and a depending wall extending from a lower end of the support panel.

The tool storage bag can be removably mounted to the support panel.

Preferably, the support panel has at least one hook and the tool bag has a corresponding loop, which is received above the hook on the panel to removably mount the tool bag to the support panel. There can be multiple hook and loop combinations provided between the support panel and the storage bag.

The support panel can further comprise a planar wall and a lower wall extending from the planar wall near a lower end of the support panel wherein the tool bag is supported by the lower wall.

The tool bag can have an open portion that is closed by a portion of the support panel to at least partially define the tool storage chamber. Preferably, the tool bag open portion is an open rear portion, which is closed by a portion of the support panel when the tool bag is mounted to the support panel. The tool bag open portion can further include an open bottom portion, which is closed by a lower wall extending from the support panel. The storage bag can have an open top that is adapted to receive a vacuum cleaner tool and which provides access to the storage chamber. The tool bag also preferably has at least a portion that is transparent to permit the viewing of at least a portion of the tool chamber from outside the tool bag.

In another embodiment of the invention, a tool storage module comprises a support panel adapted to be removably mounted to the vacuum cleaner handle in combination with a tool bag having at least a portion of which is transparent to permit the viewing of the interior of the tool bag from the outside of the tool bag.

In yet another embodiment of the invention, the tool storage module comprises a support panel adapted to be mounted to the vacuum cleaner handle having a cord wrap on the support panel and a tool bag being removably mounted to the support panel and at least partially defining a tool storage chamber.

BRIEF DESCRIPTION OF THE DRAWINGS

The invention will now be described with reference to the drawings wherein.

DESCRIPTION OF THE PREFERRED EMBODIMENTS

Figure 1:
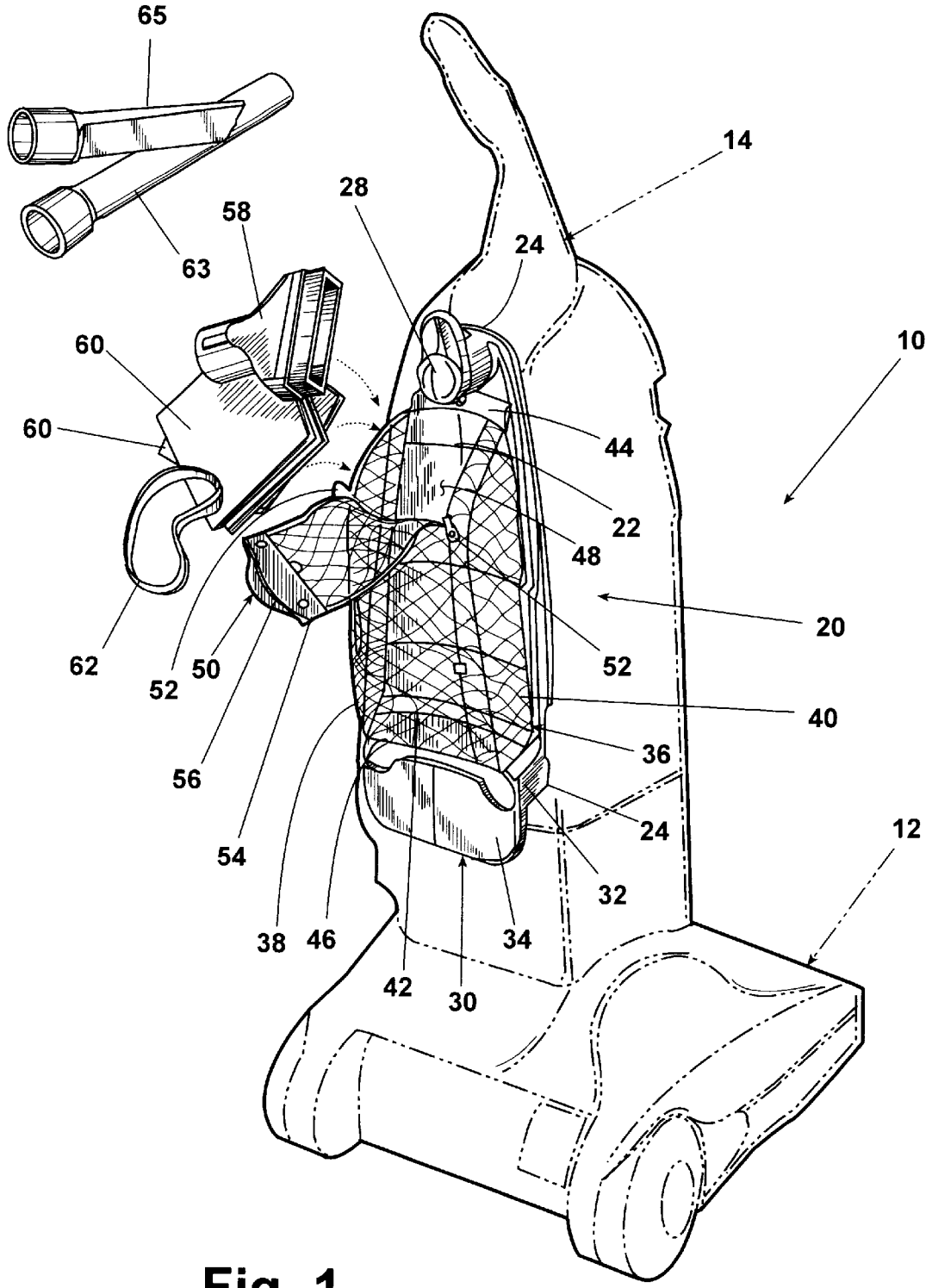
FIG. 1 is a perspective view of a first embodiment of a storage bag for an upright vacuum cleaner shown in phantom outline.

Referring now to the drawings, a conventional upright vacuum cleaner 10 is shown and generally comprises a suction-creating base 12 having a pivotably-mounted handle assembly 14 attached thereto. The handle assembly 14 typically includes a filter bag (not shown) adapted to collect debris from the base 12.

Often, the handle assembly 14 of an upright vacuum cleaner includes a rigid housing that contains the filter bag. Tools are generally stored on the handle assembly 14 in specially-shaped crevices or recesses. Alternatively, the handle assembly 14 includes a handle shaft having a collapsible bag that contains the filter bag. In either case, vacuum tools and accessories are often stored on the handle assembly 14 adjacent a filter bag housing.

Referring to FIG. 1, a first embodiment of a tool storage module 20 is shown comprising a support panel 22 having a planar portion extending longitudinally along the handle assembly 14 of the vacuum cleaner 10 and having upper and lower ends 24 and 26. The upper end 24 of the support panel 22 can be provided with a cord wrap knob 28. The lower end 26 of the support panel 22 can be provided with a handle 30 for carrying the vacuum cleaner 10. The handle is formed by a horizontally-extending lower wall 32 which terminates in a depending wall 34. The handle 30 also functions as a lower portion of a cord wrap assembly when used in conjunction with the cord wrap knob 28 at the upper portion of the support panel 22.

A storage bag 36 is shown mounted to the tool storage module 20 in FIG. 1. The storage bag 36 is preferably made from a transparent material, such as a mesh fabric. However, other fabrics and constructions are suitable as long as at least a portion of the interior of the storage bag are viewable from outside the storage bag. The storage bag 36 comprises side panels 38 and 40 and a lateral panel 42. The rear and bottom of the storage are open and closed by the planar portion and lower wall, respectively, of the support panel 20. Upper edges of the side panels 38 and 40 are retained within a clasp 44 which is mounted to the support panel 22 of the tool storage module 20 in a conventional manner, such as with threaded fasteners or a snap-fit mounting. It will be understood that the clasp 44 can also comprise any conventional mounting assembly, such as hooks. Lower edges of the side panels 38 and 40 and the lateral panel 42 are mounted to an upper perimetrical edge 46 of the horizontally-extending lower wall 32.

In general, storage of the chamber 48 is formed by the storage bag 36 and the support panel 22. Specifically, the chamber 48 is defined in the rear by the planar portion of the support panel 22, at the bottom by lower wall 32, at the sides by side panels 38 and 40, and at a plane remote from the support panel 22 by the lateral panel 42. A flap 50 is formed in the storage bag 36 and is selectively closeable by a conventional closure such as zippers 52 shown in FIG. 1. It will be understood that alternative closures, such as hook-and-loop, snaps, buttons, etc., can be employed without departing from the scope of this invention. The flap 50 can also have a distal edge 54, which has a rigid flange 56 thereon adapted to mate with the clasp 44 on the tool storage module 20. The closure for the flap 50 can also be carried on the flange 56 without departing from the invention. Alternatively, the flange 56 and the clasp 44 can be provided with magnetic attraction members which act as the closure for the flap 50.

Various vacuum cleaner accessories, such as an upholstery tool 58, filter bags 60, replacement belts 62, extension wand 63, and a crevice tool 65 can be stored in the chamber 48. Also, cleaning materials can also be stored in the long. Thus, the tool storage bag 36 provides greater convenience and flexibility over prior art tool storage assemblies by allowing a user to select particular items to carry on the vacuum cleaner 10. For purposes of this description, the term tool is used as a generic reference to any item stored in the storage bag, including, without limitation, tools and accessories for the vacuum.

Figure 2:
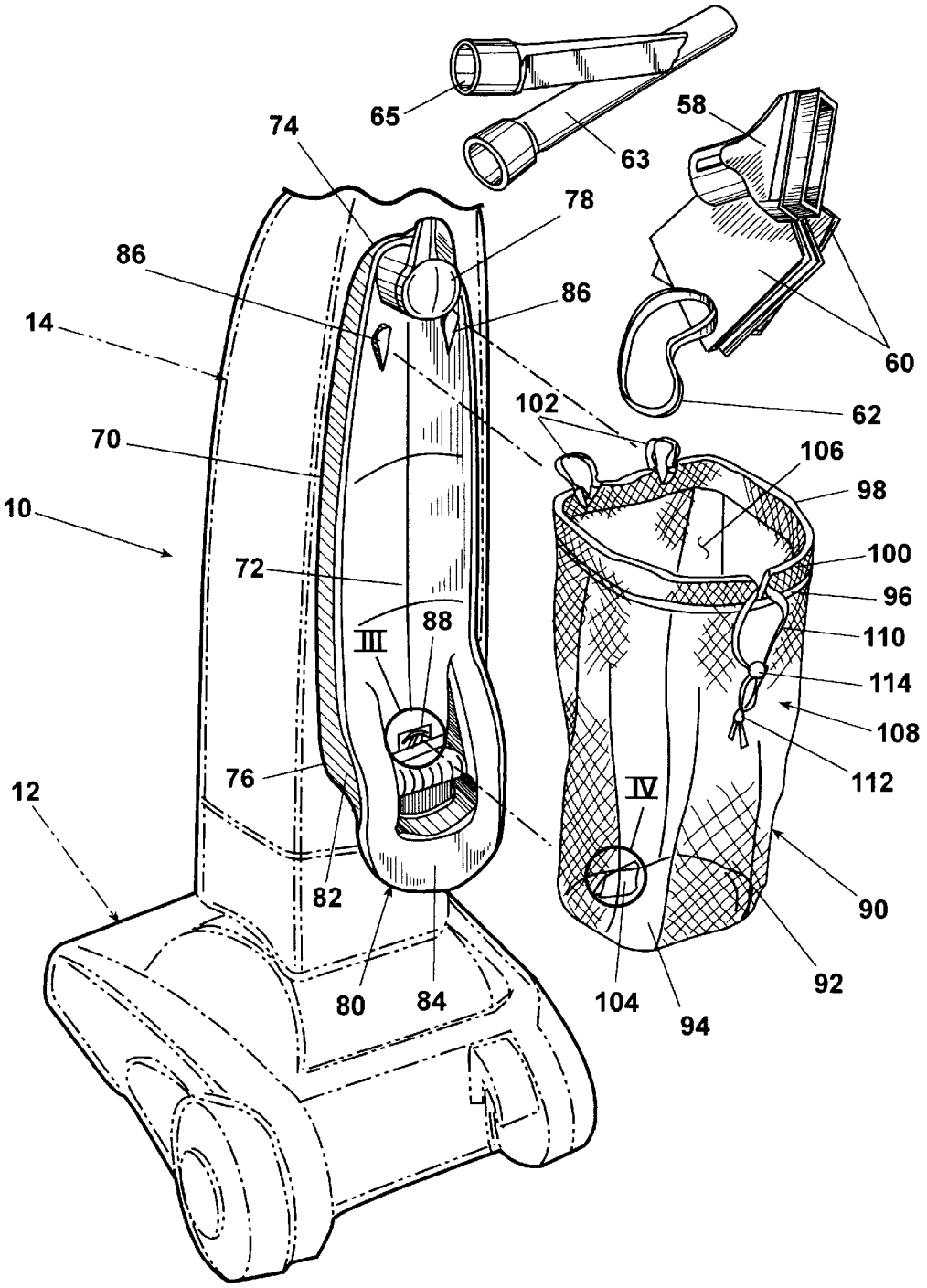
FIG. 2 is a perspective view of a second embodiment of a storage bag, also shown with an upright vacuum cleaner in phantom outline.
Figure 3:
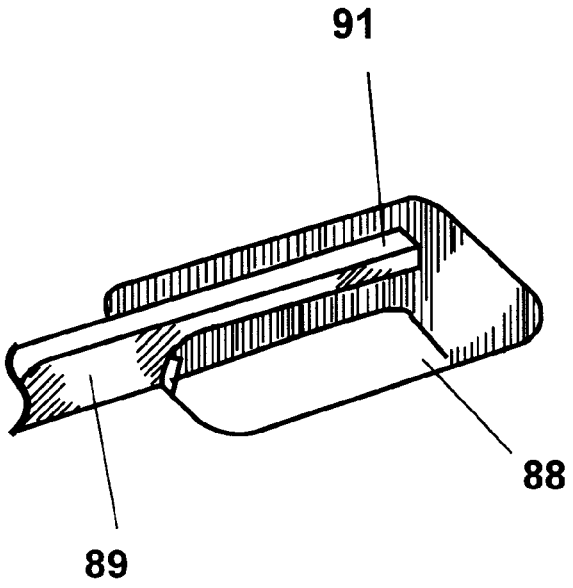
FIG. 3 is an enlarged fragmentary perspective view of the region of FIG. 2 marked III.
Figure 4:
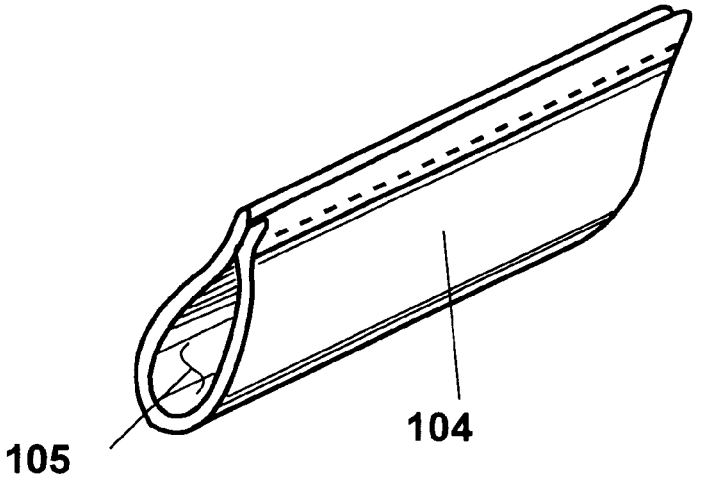
FIG. 4 is an enlarged fragmentary perspective view of the region of FIG. 2 marked IV.

Referring now to FIGS. 2–4, a second embodiment of a tool storage module 70 is shown comprising a support panel 72 having a planar portion which extends longitudinally along the handle assembly 14 of the vacuum cleaner 10 and has upper and lower ends 74 and 76. As in the previous embodiment, the upper end 74 of the support panel 72 can be provided with a cord wrap knob 78 thereon. The lower end 76 of the support panel 72 can be provided with a handle 80 for carrying the vacuum cleaner 10, which comprises a horizontally-extending flange 82 that terminates in a depending wall 84. A pair of hooks 86 in a spaced horizontal relationship are provided adjacent the upper end 74 of the support panel 72. A slot 88 is provided adjacent a central longitudinal axis (not shown) of the support panel 72. As shown in greater detail in FIG. 3, the slot 88 includes a finger 89 mounted adjacent thereto which has a cantilevered distal end 91 extending substantially across the width of the slot 88.

A storage bag 90 is shown mounted to the tool storage module 70 in FIG. 2. As in the previous embodiment, the storage bag 90 is preferably made from a transparent material, such as a mesh fabric. The storage bag 90 comprises a cylindrical side panel 92 and a bottom panel 94. A seam 96 is located adjacent an upper edge 98 of the side panel 92 to define a circumferential passageway 100 therebetween. A pair of loops 102 are located in a spaced relationship along the upper edge 98 which preferably corresponds to the spacing of the hooks 86 on the tool storage module 70. A tab 104 is located adjacent the bottom panel 94 of the storage bag 90. As shown in greater detail in FIG. 4, the tab 104 can comprise a sewn loop of material which defines a passageway 105 therethrough.

A storage chamber 106 is thereby defined by the side panel 92 and the bottom panel 94 and opens upwardly within the upper edge 98. A closure 108 is carried on the storage bag 90 for closing the storage chamber 106 such as drawstring 110 which is disposed within the passageway 100. The drawstring 110 is closed by a knot 112 and has a slide member 114 thereon for selectively adjusting the size of the opening of the storage chamber 106. It will be understood that other closures such as zippers, hook-and-loop, snaps, buttons, magnets, etc., can be employed without departing from the scope of this invention.

The drawstring 110 can also function as a handle for holding the storage bag 90. Alternatively, a separate handle, for example a loop sewn to the storage bag 90, can be provided on the storage bag 90, permitting the user to carry the storage bag 90 independently of the vacuum.

The storage bag 90 is mounted to the tool storage module 70 by passing the loops 102 of the storage bag 90 over the hooks 86 on the tool storage module 70. The tab 104 is mounted within the slot 88 by passing the tab 104 over the distal end 91 of the finger 89 so that the finger 89 is disposed within the passageway 105. The hooks 86 and finger 89 are preferably oriented transversely relative to each other to reduce the likelihood the storage bag can be dislodged during use of the vacuum cleaner.

Various vacuum cleaner tools accessories, such as an upholstery tool, a crevice tool 65, a dust brush 58, filter bags 60, replacement belts 62, and an extension wand 63 can be stored in the storage chamber 106. Thus, the tool storage bag 90 provides greater convenience and flexibility over prior art tool storage assemblies by allowing a user to select particular items to carry on the vacuum cleaner 10.

An additional benefit of the tool storage module 70 is the capability of the storage bag 90 to be easily removed and remounted. Thus, a user could be provided with several different storage bags 90 which contain various types of supplies from which the user could select depending upon the type of cleaning to be done. Examples of various types of supplies include, but are not limited to, an upholstery cleaning kit, a protectant kit, and a spot and stain kit, in addition to traditional vacuum cleaning accessories.

It will be further understood that, although the preceding embodiments where shown in conjunction with a conventional upright vacuum cleaner, the tool storage assemblies described herein can also be used with canister vacuums and conventional deep cleaning or water extractors without departing from the scope of this invention. The bag can also be carried by a user, independent of the vacuum.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

We claim:

1. A vacuum cleaner comprising a handle rotatably mounted to a floor engaging base having a suction nozzle, a filter chamber mounted to the handle for collection of debris from the suction nozzle, and multiple tools for the physical and cleaning operations of the vacuum cleaner, the improvement comprising:

a support panel adapted to be mounted to the vacuum cleaner handle; and a pliable tool bag, separate from the filter chamber mounted to the support panel and at least partially defining a tool storage chamber of a size to hold the multiple tools for the vacuum cleaner.

2. A tool storage module according to claim 1 wherein the support panel further comprises at least one cord wrap element adapted to receive wound plies of a vacuum cleaner cord.

3. A tool storage module according to claim 2 wherein there are two cord wrap elements and the cord wrap elements extend from the support panel and are spaced from each other.

4. A tool storage module according to claim 3 wherein the support panel is elongated with an upper and a lower end and one of the cord wrap elements is a cord wrap knob positioned near the upper end of the support panel and the other of the cord wrap elements is a depending wall extending from the lower end of the support panel.

5. A tool storage module according to claim 1 wherein the tool bag is removably mounted to the support panel.

6. A tool storage module according to claim 5 wherein the support panel has at least one hook and the tool bag has a loop corresponding to the at least one hook and the loop is received over the at least one hook to removably mount the tool bag to the support panel.

7. A tool storage module according to claim 6 wherein the support panel has a planar wall with opposite ends, and wherein the at least one hook comprises a first hook near one of the opposite ends and a second hook near the other of the opposite ends, and the tool bag has a loop corresponding to each of the hooks.

8. A tool storage module according to claim 7 wherein the support panel has a lower wall extending from the support panel near the support panel lower end and the second hook is positioned near the lower wall and the corresponding loop is mounted near a bottom portion of the tool bag.

9. A tool storage module according to claim 7 wherein the first hook is transversely oriented relative to the second hook to reduce the likelihood that the tool bag will accidentally fall off the support panel.

10. A tool storage module according to claim 1 wherein the support panel comprises a planar wall having an upper end and a lower end and a lower wall extending from the planar wall near the lower end wherein a portion of the tool bag is supported by the lower wall.

11. A tool storage module according to claim 10 wherein the support panel further comprises a cord wrap knob positioned near the upper end and a depending cord wrap wall extending from the lower wall.

12. A tool storage module according to claim 1 wherein the tool bag has an open portion that is closed by a portion of the support panel to at least partially define the tool storage chamber.

13. A tool storage module according to claim 12 wherein the tool bag open portion is an open rear portion that is closed by a portion of the support panel when the tool bag is mounted to the support panel to at least partially define the tool storage chamber.

14. A tool storage module according to claim 13 wherein the tool bag open portion further comprises an open bottom portions and the support panel further comprises a lower wall extending from the support panel and closes the tool bag open bottom portion to at least partially define the tool storage chamber.

15. A tool storage module according to claim 1 wherein the tool bag has an open top adapted to receive a vacuum cleaner tool and providing access to the tool storage chamber.

16. A tool storage module according to claim 15 wherein the tool bag has a cover for closing the open top.

17. A tool storage module according to claim 16 wherein the cover is a flap provided on the tool bag and the flap overlies the open top to close the open top.

18. A tool storage module according to claim 16 wherein the tool bag comprises a flexible material having an opening in the material that defines the open top and the cover is a drawstring provided in the flexible material.

19. A tool storage module according to claim 1 wherein at least a portion of the tool bag is transparent to permit the viewing of at least a portion of the tool chamber from outside the tool bag.

20. A tool storage module according to claim 19 wherein the tool bag is made from a mesh material and the mesh openings define the transparent portion of the tool bag.

21. A tool storage module according to claim 1 wherein the tool bag further comprises a handle for carrying the tool bag.

22. A vacuum cleaner comprising a handle rotatably mounted to a floor engaging base having a suction nozzle, a filter chamber mounted to the handle for collection of debris from the suction nozzle, and multiple tools for the physical and cleaning operations of the vacuum cleaner, the improvement comprising:

a support panel mounted to the vacuum cleaner handle; and a pliable tool bag separate from the filter chamber, mounted to the support panel and defining a tool storage chamber, and at least a portion of the tool bag is transparent to permit the viewing of the tools inside the tool bag from the outside of the tool bag.

23. A tool storage module according to claim 22 wherein the tool bag is made from a mesh fabric having open spaces that provide the transparent portion of the tool bag.

24. A tool storage module according to claim 22 wherein the tool bag is removably mounted to the support panel.

25. A tool storage module for a vacuum cleaner comprising a handle rotatably mounted to a floor engaging base and multiple tools for the physical and cleaning operations of the vacuum cleaner, the tool storage module comprising:

a support panel adapted to be mounted to the vacuum cleaner handle;

a cord wrap on the support panel; and a pliable tool bag removably mounted to the support panel and at least partially defining a tool storage chamber adapted to hold a tool for the vacuum cleaner.

26. A tool storage module according to claim 25 wherein the support panel includes an elongated planar portion with an upper and a lower end and the cord wrap comprises a knob positioned near the upper end of the planar portion and a wall extending from the lower end of the planar portion whereby the knob and wall are adapted to have a cord wrapped around them.

27. A tool storage module according to claim 26 wherein the wall comprises a first portion extending away from the planar portion and a second portion depending from the first portion wherein the first portion is adapted to have a cord wrapped about it and the second portion is adapted to prevent the cord from coming off the first portion.

28. A tool storage module for a vacuum cleaner comprising a handle rotatably mounted to a floor engaging base and multiple tools for the physical and cleaning operations of the vacuum cleaner, the tool storage module comprising:

a support panel adapted to be mounted to the vacuum cleaner handle and having at least one hook; and a pliable tool bag mounted to the support panel and at least partially defining a tool storage chamber adapted in size to hold multiple tools for the vacuum cleaner and having a loop corresponding to the at least one hook wherein the loop is received over the hook to mount the tool bag to the support panel.

29. A tool storage module according to claim 28 wherein the tool bag is removably mounted to the support panel.

30. A tool storage module for a vacuum cleaner comprising a handle rotatably mounted to a floor engaging base and multiple tools for the physical and cleaning operations of the vacuum cleaner, the tool storage module comprising:

a support panel adapted to be mounted to the vacuum cleaner handle and having a cord wrap knob positioned near an upper end of the support panel and a depending cord wrap wall extending from a lower wall thereof; and a pliable tool bag mounted to the support panel and at least partially defining a tool storage chamber adapted in size to hold multiple tools for the vacuum cleaner.

31. A tool storage module according to claim 30 wherein the support panel comprises a planar wall having an upper end and a lower end and a lower wall extending from the planar wall near the lower end wherein a portion of the tool bag is supported by the lower wall.

32. A tool storage module according to claim 30 wherein the tool bag has an open rear portion that is closed by a portion of the support panel when the tool bag is mounted to the support panel to at least partially define the tool storage chamber.

33. A vacuum cleaner comprising a handle rotatably mounted to a floor engaging base having a suction nozzle, a filter chamber mounted to the handle for collection of debris from the suction nozzle, and multiple tools for the physical and cleaning operations of the vacuum cleaner, the improvement comprising:

a support panel adapted to be mounted to the vacuum cleaner handle; and a tool bag, separate from the filter chamber, mounted to the support panel and at least partially defining a tool storage chamber adapted in size to hold multiple tools for the vacuum cleaner, wherein the tool bag is formed from a flexible material having an opening in the material that defines an open top for access to the tool storage chamber, and wherein the tool bag has a closure in the flexible material for selectively closing the open top of the tool storage chamber.

34. A tool storage module according to claim 33 wherein the closure comprises a drawstring.

35. A tool storage module according to claim 33 wherein the closure comprises a flap on the tool bag and the flap overlies the open top to close the open top.

36. A tool storage module for a vacuum cleaner comprising a handle rotatably mounted to a floor engaging base and multiple tools for the physical and cleaning operations of the vacuum cleaner, the tool storage module comprising:

a support panel adapted to be mounted to the vacuum cleaner handle; and a tool bag mounted to the support panel and at least partially defining a tool storage chamber adapted in size to hold multiple tools for the vacuum cleaner, wherein at least a portion of the tool bag is made from a mesh material to permit the viewing of the tools inside the tool chamber from outside the tool bag.

* * * * *